United States Patent [19]

Benenson

[11] 4,095,788

[45] Jun. 20, 1978

[54] FLAG POLE HOLDER

[76] Inventor: William Benenson, 118 E. 60th St., New York, N.Y. 10022

[21] Appl. No.: 787,573

[22] Filed: Apr. 14, 1977

[51] Int. Cl.[2] ..... A63B 67/00

[52] U.S. Cl. ..... 273/34 R

[58] Field of Search ..... 273/34 R, 34 A, 34 B, 273/178 R; 116/173

[56] References Cited

U.S. PATENT DOCUMENTS

| | | | |
|---|---|---|---|
| 951,649 | 3/1910 | Matthews | 273/34 R |
| 3,790,166 | 2/1974 | Hamilton et al. | 273/34 A |

FOREIGN PATENT DOCUMENTS

| | | | |
|---|---|---|---|
| 449,776 | 7/1936 | United Kingdom | 273/34 R |

*Primary Examiner*—George J. Marlo

[57] ABSTRACT

A flag pole holder adapted for use in maintaining a golf flag pole in upright position indicating a hole on a golf green. The holder includes a cup having an upper rim surrounding an open top and is adapted to be inserted in the ground with the open top exposed. A pin is mounted in the cup extending upwardly toward the open top of the cup and terminating in a free end. The pin is positioned within the cup to removably mount an open ended flag pole thereon to hold the flag pole in an upright position with respect to the cup and facilitate its removal therefrom.

2 Claims, 3 Drawing Figures

FIG. 1
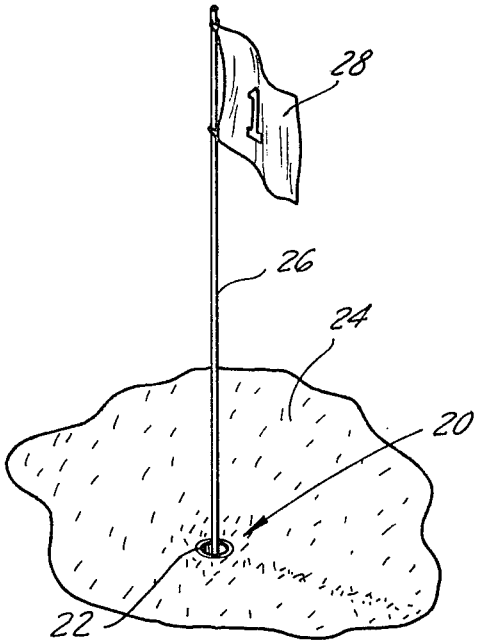
FIG. 3
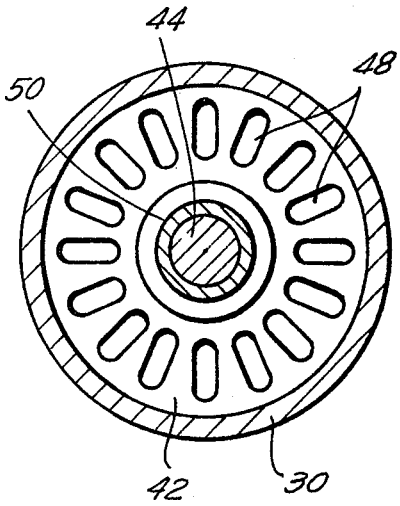
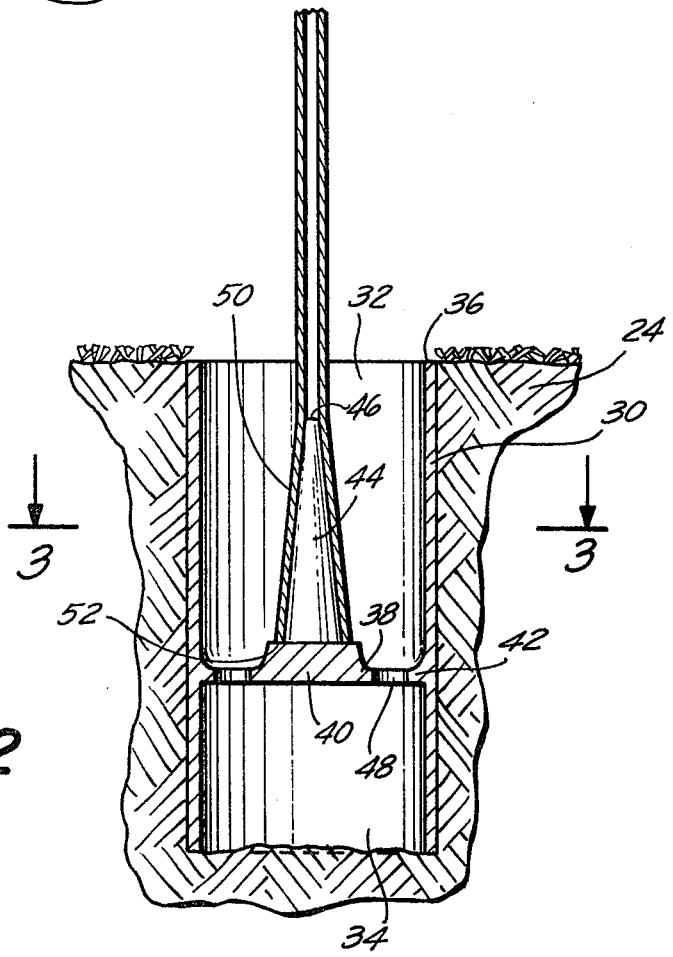
FIG. 2

FLAG POLE HOLDER

BACKGROUND OF THE INVENTION

The common manner of retaining the flag pole marking the holes on a golf green is to provide the pole with a pointed end which is designed to be removably inserted in a receiving hole in the base of a cup seated in the hole on the green.

Also, there are more complex type of fitting arrangements between the pole and the receiving cup on the green.

There are several difficulties that can arise when using the common types of flag and cup arrangements. For example, the flag can tilt due to a loose fitting arrangement, when subjected to wind forces, or even if when the flag pole is improperly or carelessly replaced in the hole. The result is that the player will have to adjust the flag prior to approaching the hole from off the green to make certain that the flag is not leaning in an undesirable direction for his shot. The ideal condition would be to have the flag remaining in an upright and vertical position in the center of the hole so that it does not favor any direction with respect to the periphery of the cup. The inconvenience of having to approach the flag when one is a considerable distance away in order to make an adjustment or check the flag prior to the gold stroke is also certainly undesirable. This inconvenience is enhanced when one considers that the flag is retained in the hole only when one is approaching the hole from off the green. When the player is on the green, the flag is removed for the putt.

Other disadvantages of the arrangement where a receivin hole is in the cup for placing the bottom end of the flag include the difficulties of locating the hole when the flag is replaced and the concern of making sure the flag is straight when one is leaving the green. Also, flag poles can be distorted or even broken at the bottom end which makes replacement in a receiving hole even more difficult. Furthermore, the hole can collect dirt and become clogged so that there is no longer a receiving hole for the bottom end of the flag pole.

SUMMARY OF THE INVENTION

With the above background in mind, it is among the primary objectives of the present invention to provide a holder for a flag pole, particularly a golf flag pole utilized on a golf green, which can be efficiently and easily utilized to retain the flag pole in a vertical upright central position in the hole on the green at all times. In this manner, the need to adjust the flag which may be tilted due to improper placement in the hole, damage to the bottom of the pole so that it doesn't properly fit in the hole, or wind conditions is avoided. It is an objective to provide a holder with a central pin extending upwardly from the base of the holder with the pin being tapered to be received within a corresponding tapered opening in the bottom end of the flag pole. With this arrangement, the danger of dirt or other substances clogging a hole in the cup is avoided and the flag pole can be retained in a more upright position due to a pin of sufficient length relative to the height of the flag pole to prevent tipping.

Additionally, it is an objective to provide a receiving pin arrangement in the cup for permitting ease of removal and insertion of the bottom end of the golf flag pole containing a receiving aperture therein. The holder is simple in construction and design thereby providing a low cost product and making it more dependable and efficient in repeated use over a long period of time while minimizing the danger of damage or deterioration of the holder or the flag pole. There is a minimum danger of breakage of the bottom of the flag pole since it is captured on an elongated pin within the cup. It is contemplated that the cup should be designed with a predetermined vertical height so that the pin housed therein is well below the upper rim of the cup and does not interfere with the action of the ball as it stroked and deposited in the hole.

Furthermore, it is an objective to provide a tapered pin within the cup which tapers toward a pointed upper end to facilitate introduction of the corresponding tapered hole in the bottom of the flag pole and removal thereof with respect to the pin when the flag pole is positioned and removed in the holder.

The cup is also designed to include a lower portion below a base wall with apertures in the base wall to permit drainage of water collected within the cup to the ground through an open bottom end of the cup through the base wall. The pin is mounted on the base wall and extends upwardly therefrom to a predetermined point below the upper rim of the cylindrically shaped holder.

In summary, a flag pole holder is provided which includes a cup having an upper rim surrounding an open top and is adapted to be inserted in the ground with the open top exposed. A pin is mounted in the cup extending upward toward the open top of the cup and terminating in a free end. The pin is in position within the cup to removably mount an open ended flag pole thereon to hold the flag pole in an upright position with respect to the cup.

With the above objectives among others in mind, reference is made to the attached drawings.

BRIEF DESCRIPTION OF THE DRAWINGS

In The Drawings

FIG. 1 is a perspective view of the holder of the invention used as a cup for the hole on a golf green and holding the golf flag pole in position on the green to indicate location of the hole;

FIG. 2 is a fragmentary sectional elevation view thereof; and

FIG. 3 is a sectional top view thereof taken along the plane of line 3—3 of FIG. 2.

DESCRIPTION OF THE PREFERRED EMBODIMENTS

Holder 20 is designed for use in holding a flag pole in an upright position. It can be utilized with any of a number of different types of flag poles. By way of example, the depicted embodiment in the drawing shows the holder 20 used as a cup on a golf green for removably coupling with a golf flag pole to indicate the location of the hole on the green.

As depicted in perspective form in FIG. 1, holder 20 is inserted in a hole 22 at a predetermined location on golf green 24. A golf flag pole 26 has its bottom end mounted in holder 20 and has a flag 28 attached to its upper end indicating the number of the hole with the flag and pole indicating the location of the hole.

Holder 20 is formed of a conventional plastic or metal material such as steel or aluminum. Holder 20 is cylindrical in configuration and has an elongated peripheral tubular side wall 30 with an opening 32 at the upper end and an opening 34 at the lower end. The upper edge of tubular wall 30 forms an annular rim 36 surrounding the upper opening of the cup forming the holder. Intermediate the ends of the elongated cylindrical holder 20 is a base wall 38. The base wall extends diametrically across the entire diameter of holder 20 forming a cup to be positioned in a hole in the ground as depicted in the drawings. The base wall has a central main portion 40 and a web like peripheral portion 42 connecting the central portion 40 with the inner surface of the tubular side wall 30. Extending upwardly from central portion 40 is an elongated spike or pin 44 which tapers inwardly as it extends from the base 40 toward a narrower diameter free end tip 46. The pin 44 can be integrally formed to base wall 38 or can be attached in any conventional fashion such as by welding or by appropriate fasteners.

A plurality of equally separated elongated apertures or holes 48 are radially located in the generally circular web portion 42 with the longer axis of each of the apertures being radially oriented from the center of the web so as to provide drainage holes for material such as water or dirt collecting above the web 42 and within the upper portion of holder 20 so that the material can easily pass through the apertures 48 and exit through the bottom open end 34 of holder 20 into the ground at the bottom of the hole. This avoids collection of the material in the upper cup portion utilized to receive the golf balls.

The bottom end portion 50 of flag pole 26 tapers outwardly toward the bottom edge 52 in a manner corresponding to the tapered configuration on the receiving pin 44. Naturally the opening in bottom end portion 50 is slightly larger than the outer diameter of the pin 44 so that the flag pole can reciprocally slide on and off the pin as the flag is inserted and removed from the holder respectively. The dimensional difference is designed so that there is interengagement between the flag pole and the pin to assist in holding the flag pole in the most upright and vertical position and while permitting ease of removal and coupling of the flag pole and the pin. The flag pole 26 is also conventionally formed of a plastic or metal material, such as steel or aluminum.

In use, a hole 22 is formed in a conventional fashion in green 24 of a predetermined depth to accommodate th elongated holder 20. The holder is then inserted into the hole until the upper rim 36 is even with the ground surface or slightly below. This is to avoid interference between the holder 20 and a golf ball being directed toward the hole for reception therein. For this same purpose, pin 44 is made significantly shorter than the distance of wall 30 between the base wall and the upper rim 36 so that the pin does not interfere with the ball as it is being stroked into the hole.

The flag pole 26 is then inserted onto the pin marking the location of the hole. As stated above, the height of the pin is designed so that it is long enough with respect to the height of the flag pole to facilitate holding of the flag pole in an upright and vertical position.

When water or dirt material collects through open upper end 32 it can drain through drain holes 48 into the lower portion of the holder 20 and out through the bottom open end 34 into the surrounding ground. Thus there is no inconvenience of material collecting in the hole when the greens are watered or during a rain.

The flag pole can be easily removed and replaced on the pin where it will remain in a vertical and upright position and parallel to the tubular side walls of the cup which is positioned vertically in the hole. For this purpose, the pin 44 is maintained in an upright and vertical position in a central location equidistant from all points of the peripheral inner surface of the tubular portion 30 of the holder 20. Thus the central upright location of the flag pole with respect to the hole is assured.

The flag is prevented from tilting, is easy to remove and replace with respect to the cup and eliminates the necessity of the player having to adjust the flag prior to making a shot from off the green. Also, the arrangement of the present invention avoids the danger of breakage at the bottom end of the flag pole which could destroy the mounting relationship between the flag pole and the holder. The flag pole can be pulled up quickly or slowly without danger of jamming. There is no danger of dirt accumulating in the receiving hole of the cup to interfere with the coupling relationship between the flag pole and the holder. The result is an advantage and improved arrangement which is particularly useful as a holder for a flag pole on a golf green.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A golf ball cup including a flag pole holder comprising:

a unitary elongated holder body, open at both ends, which is cylindrical in configuration and adapted for closely fitting into a designated hole of predetermined depth at a predetermined location on the golf green, the upper rim of said holder body being slightly below or just even with the ground surface of said designated hole and the bottom rim resting on the bottom of said hole;

a generally circular web the periphery of which is integrally attached to the cylindrical wall within said holder body generally intermediate the top and bottom rims of said body;

a centrally located pin member having tapering sides projecting above said web at the center thereof and integral with said web, said pin member fitting into the tapered bottom opening of the flag pole to thereby support said flag pole in an upright position;

a plurality of equally separated elongated openings radially disposed in said web about said centrally located pin to the periphery of the web adapted for easy draining of water, dirt and mixtures thereof through said web into the ground at the bottom of the cup;

said centrally located pin being adapted to engage a tapered bottom opening in a golf flag pole to thereby maintain said pole in an upright condition in the center of the cup on the web as the load supporting means; and said pin having a height which is below the upper rim of said cup and below the ground surface whereby there is no obstruction by said pin to a golf ball entering the cup.

2. The combination of claim 1 including a flag pole having an opening in the lower end thereof, said opening including upwardly converging side walls to accomodate the tapering sides of the pin member and thereby center and support the flag pole.

* * * * *